United States Patent [19]

Liberman et al.

[11] Patent Number: 4,966,181

[45] Date of Patent: Oct. 30, 1990

[54] BEACH WIND-SHIELDING AND SIGNALLING DEVICE

[76] Inventors: Michael Liberman; Gary Kann, both of 935 Northern Blvd. Suite 300, Great Neck, N.Y. 11021

[21] Appl. No.: 478,553

[22] Filed: Feb. 12, 1990

[51] Int. Cl.[5] ..... E04H 15/00

[52] U.S. Cl. ..... 135/87; 135/114; 135/902

[58] Field of Search ..... 135/114, 902, 87, 900

[56] References Cited

U.S. PATENT DOCUMENTS

| | | | |
|---|---|---|---|
| 1,828,147 | 10/1931 | Kamman | 135/902 X |
| 2,208,458 | 7/1940 | Julian et al. | 135/87 |
| 2,619,101 | 11/1952 | McGerry et al. | 135/87 |
| 2,771,088 | 11/1956 | Soldan | 135/87 |
| 2,970,600 | 2/1961 | Schultz . | |
| 2,997,277 | 8/1961 | Schwartz . | |
| 3,537,688 | 11/1970 | Stein | 135/902 |

FOREIGN PATENT DOCUMENTS

| | | | |
|---|---|---|---|
| 0234126 | 11/1959 | Australia | 135/902 |
| 527450 | 10/1940 | United Kingdom | 135/114 |

*Primary Examiner*—David A. Scherbel
*Assistant Examiner*—Lan Mai

[57] ABSTRACT

A rectangular fabric article of manufacture vertically supported on poles on a beach so that users on the leeward side are shielded from wind, and having color indicia or the like imprinted on the windward side to serve as a location-indicating visual signal.

1 Claim, 1 Drawing Sheet

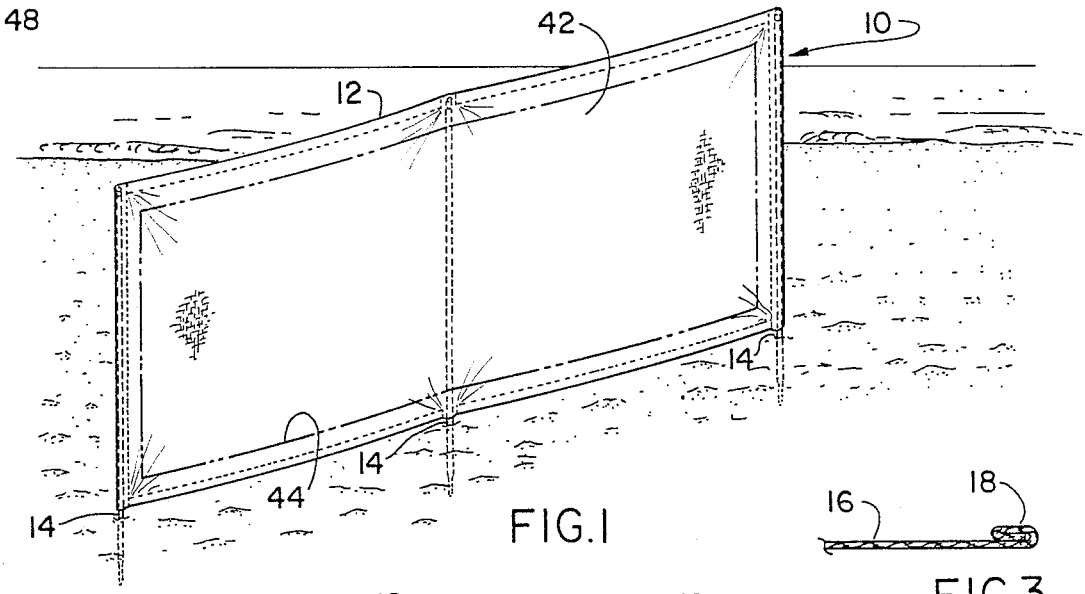
FIG.1
FIG.3
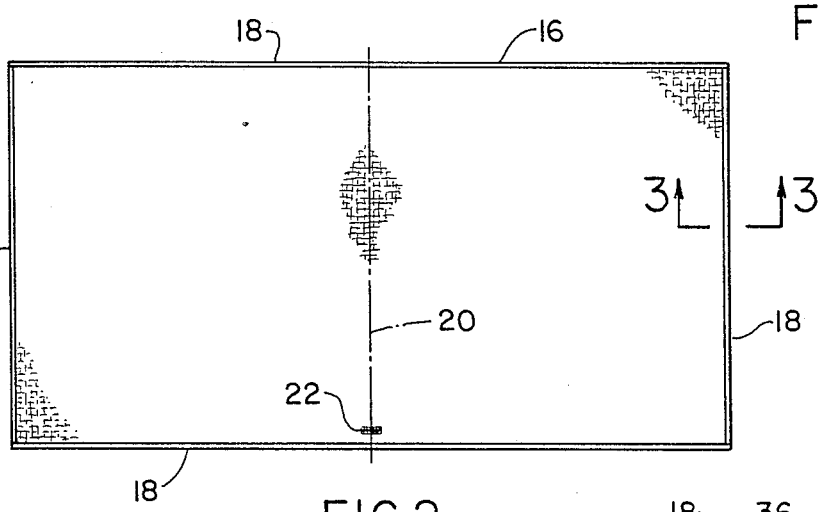
FIG.2
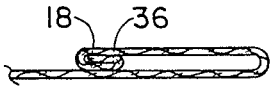
FIG.6
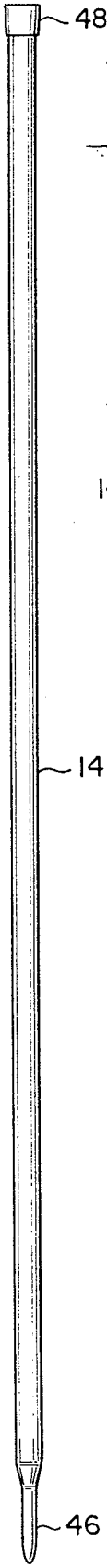
FIG.4
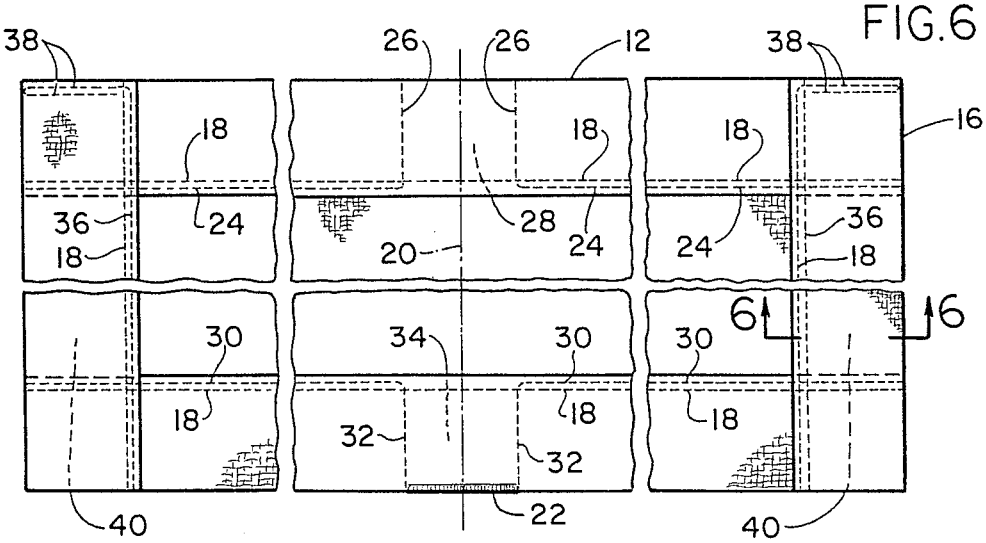
FIG.5

BEACH WIND-SHIELDING AND SIGNALLING DEVICE

The present invention relates a pole and fabric body assembly adapted to be erected on a beach to serve both as a wind-shielding device and also to provide as a visual signal for locating the user, particularly on a crowded beach.

EXAMPLE OF THE PRIOR ART

It is really well known to construct fabric structures, using poles for support, on beaches to function as shields against prevailing directional beach winds of the particular beach of use, such as for example, the beach structures of Schultz, U.S. Pat. No. 2,970,600 issued on Feb. 7, 1961 and Stein, U.S. Pat. No. 3,537,688 issued on Dec. 16, 1968. These patented beach structures however provide only the wind-shielding function of the within inventive device and constructionwise are more complicated, expensive, and in other respects less desireable.

Of the beach structures in the referenced prior art category characterized by Schultz and Stein, it is necessary to particularly note the beach shelter of Schwartz U.S. Pat. No. 2,997,277 issued on Aug. 22, 1961. This patented structure is formed of a pliable plastic member supported on 5 poles in a semi-circular configuration, which effectively serves as a shield against wind for users located on the leeward side of the plastic member.

Although the semi-circular shape of the Schwartz structure, and the FIG. 6 shape of the Stein structure, is similar to the triangular shape of the within inventive device, they are achieved using more than an optimum three poles used by applicant, thus lacking the ease of set-up and full functional use achieved by applicant.

Generally, it is an object of the present invention to provide a device for use on a beach serving as a wind shield and having other significant functions, overcoming the foregoing and other shortcomings of the prior art.

More specifically, it is an object to provide a pole and fabric body assembly for beach use, requiring only three support poles for providing the fabric body with what aptly is characterized as a shallow triangular shape, wherein the angular orientation of each of the supported sides of the fabric body is adequate to reflect the wind, and wherein the windward side thereof is nevertheless perceived as a rectangular display in which indicia, preferably provided by color but possibly also consisting of word messages or the like, is readily observed and thus functions as a visual signal for locating the device particularly on a crowded beach.

Additionally, it is an object to provide a finished appearance to the edges of the fabric body using hems along these edges, and to utilize to advantage these hems as enclosures for the poles, thereby minimizing the cost and also facilitating the set-up of the within device, all as will be explained in greater detail subsequently herein.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view of the within inventive device as intended to be used;

FIG. 2 is a rear elevational view of the fabric body component after an initial stage of edge-hemming;

FIG. 3 is a sectional view as taken along line 3—3 of FIG. 2;

FIG. 4 is a detailed elevational view showing a support pole of the device;

FIG. 5 is a rear elevational view, reduced in size by being broken as indicated, which is similar to FIG. 2, but showing the fabric body in a subsequent state of edge-hemming; and FIG. 6 is a sectional view as taken along line 6—6 of FIG. 5.

The wind protection and signalling device 10 according to the present invention is shown in FIG. 1 and is comprised of a fabric body or panel 12 supported on three poles 14. In a preferred model, panel 12 is made of a closely woven nylon blank 16, of any desired color, which measures 40″×76″. A border hem 18 is doubled back and stitched along the four edges of blank 16 (FIGS. 2 and 3) to provide a finished appearance to these edges. At the center 20 of panel 16, near the lower edge and one and one half inches above hem 18, an opening 22 is made (FIG. 2) for a purpose to be noted. Opening 22 is about one and one half inches wide and is reinforced along its edges like a a button hole.

Blank 16, with border hem 18 and opening 22, is next provided with a one and one half inch wide horizontal hem 24 along its top edge. As best seen in FIG. 5, hem 24 is started at the outside edges of blank 16 and sewn towards the center 20. At a point ¾″ before center line 20, the stitching of hem 24 is turned upwards as at 26. This arrangement delineates or creates a pocket 28 approximately 1½″ square, for a purpose also to be subsequently noted.

Along the lower edge of blank 16 a similar horizontal seam 30 is sewn. Also best seen in FIG. 5, hem 30 is started at the outside edges of panel 16 and sewn towards the center 20. At a point ¾″ before centerline 20, the stitching of hem 30 is turned downward, as at 32. This arrangement creates a pocket 34 similar to pocket 28 above, and it is to be noted that opening 22 allows access into the pocket 34 by serving as an opening thereinto.

Like hems 24 and 30, a 1½″ wide hem 36 is made along each of the vertical or side edges of blank 16. Stitching for hem 36 starts at the lower edge of panel 16 and is turned outward at 38 just before reaching the top edge. Horizontal section 38 of hem 36 is double stitched for reinforcement. This arrangement forms elongated pockets or tubular configurations 40 along the outboard side edges of panel 16.

After the aforesaid stitching of blank 16, the construction thereof is completed and the finished dimensions of cloth panel 12 are approximately 36″×η″.

The front race 42 of finished panel 12 is primarily reserved as a delineated display area for advertising indicia 33 which is silk screened or otherwise imprinted thereon. Preferably indicia 44 will be high visibility color, either in block or other shape form, or even in the specific form of letters providing a readable message or the like.

As shown in FIG. 1, cloth panel 12 is erected on three poles 14 at the selected beach site to block wind for a leeward positioned user. In the model shown, the poles are each made of ⅝″ aluminium tubing with a swagged tip 46. A plastic cap 48 is used to close the upper end of each pole 14.

At erection time, two of poles 14 are inserted within the side panel pockets 40, capped end first. The remaining pole 14 is inserted through opening 22 and through pocket 34 along center line 22, and finally into upper pocket 28, also with capped end first. This pole positioning leaves points 46 exposed and ready to be pressed into the sand to provide the poles with a vertical or erect position. The device 10 should be oriented so that the user can occupy the leeward side in relation to the prevailing directional beach wind, and consequently, the front or opposite windward fabric face 42 with advertising or other indicia 44 is automatically positioned for ready observation by passerbys, thus serving as a location-indicating visual signal.

When not in use, device 10 can conveniently be stored with poles 14 remaining in their respective pockets and panel 12 merely rolled about the poles then serving as a wind-up core for the fabric body 12.

It will be understood that special orientation of the three poles is such as to provide what can be aptly characterized as a shallow triangle, wherein the center pole is slightly, say 6 to 12 inches in advance of the side poles into the direction of prevailing beach wind, so that there is an appropriate angular orientation in the sides of the fabric body portions extending from the center pole to the side poles to deflect the wind. This shallow triangular shape notwithstanding, however, and as is intended to be depicted in FIG. 1, the perception of panel 12 is one of a rectangular shape that is suited to serve as a display area for location-indicating indicia 44 imprinted or otherwise applied on the windward side of panel 12.

While the particular beach structure, assembly and construction method herein shown and disclosed in detail is fully capable of attaining the objects and provided the advantages hereinbefore stated, it is to be understood that it is merely illustrative of the presently preferred embodiment of the invention and that no limitations are intended to the detail of construction or design herein shown other than as defined in the appended claims.

What is claimed is:

1. For use on a beach, a combination wind-shielding and location-indicating device comprising three poles having an operative position inserted in the sand of the beach providing each pole with a vertical orientation and having a triangular spaced relation to each other, a rectangular fabric member having a leeward side and a windward side with two opposite side and top and bottom edges disposed in supported relation on said poles so as to serve as a wind shield against any directional wind of said beach to any user of said device located on the leeward side of said fabric member in relation to said directional beach wind, said two opposite sides and top and bottom edges of said rectangular fabric body being folded over and a Hadred inwardly of the edges of said fabric so as to form tubular configurations along said edges, said tubular configurations along the opposite sides of said fabric body being closed by a top tubular configuration so as to serve as enclosures for receiving two of said side poles in projected relation therein to provide support along the opposite side edges of said fabric body, and in a medial location in said fabric body an unstitched portion of the upper tubular configuration serving as an enclosure for receiving in projected relation the top of the remaining pole and in alignment with said first unstitched tubular portion a second unstitched portion in said lower tubular configuration serving as an enclosure for receiving in projected relation the lower portion of the remaining pole so as to provide support for the center of said fabric body, and color indicia in a delineated display area on the windward side of said fabric member to serve as a location-indicating visual signal.

* * * * *